US009885224B2

(12) United States Patent
Tough et al.

(10) Patent No.: US 9,885,224 B2
(45) Date of Patent: Feb. 6, 2018

(54) BURST SLEEVE AND POSITIVE INDICATION FOR FRACTURE SLEEVE OPENING

(71) Applicant: Weatherford Technology Holdings, LLC, Houston, TX (US)

(72) Inventors: John Tough, Houston, TX (US); Justin P. Vinson, Houston, TX (US); Eric M. Blanton, Houston, TX (US); Raymond Shaffer, Fort Worth, TX (US); Luke V. Richey, Fort Worth, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 427 days.

(21) Appl. No.: 14/560,364

(22) Filed: Dec. 4, 2014

(65) Prior Publication Data

US 2015/0152709 A1 Jun. 4, 2015

Related U.S. Application Data

(60) Provisional application No. 61/911,614, filed on Dec. 4, 2013.

(51) Int. Cl.
*E21B 34/14* (2006.01)
*E21B 34/06* (2006.01)
(Continued)

(52) U.S. Cl.
CPC ..... *E21B 34/063* (2013.01); *E21B 33/12* (2013.01); *E21B 34/10* (2013.01); *E21B 34/14* (2013.01); *E21B 43/26* (2013.01)

(58) Field of Classification Search
CPC ..... E21B 34/063; E21B 34/14; E21B 43/26; E21B 33/12
See application file for complete search history.

(56) References Cited

U.S. PATENT DOCUMENTS 5,456,317 A * 10/1995 Hood, III ..... E21B 7/04 166/296
8,522,936 B2 9/2013 Lembcke et al.
(Continued)

FOREIGN PATENT DOCUMENTS

CA 2809946 A1 5/2013
EP 1967691 A1 10/2008
(Continued)

OTHER PUBLICATIONS

Decision on Grant in co-pending Russian Appl. 2014148748, dated Oct. 12, 2016, 17-pgs.
(Continued)

*Primary Examiner* — Robert E Fuller
*Assistant Examiner* — David Carroll
(74) *Attorney, Agent, or Firm* — Blank Rome LLP

(57) ABSTRACT

A downhole tool, such as a sliding sleeve, deploys on a tubing string in a borehole. The tool has a housing with an internal bore and at least one port communicating outside the housing. An insert disposed in the bore can move from a closed position to an opened position relative to the port so fluid can be communicated to the borehole. A burst band disposed outside the housing at the port can break away from the housing in response to a particular pressure level communicated through the open port. In particular, the insert can have a seat that engages a deployed plug or ball. The insert shifts open when a first level of applied pressure against the seated ball shears the insert free. This can give a first indication that the insert has moved open. Then, a second level of pressure can be detected when the burst band breaks as a second indication that the insert is opened.

17 Claims, 8 Drawing Sheets

(51) Int. Cl.

| | |
|---|---|
| ***E21B 33/12*** | (2006.01) |
| ***E21B 34/10*** | (2006.01) |
| ***E21B 43/26*** | (2006.01) |

(56) References Cited

U.S. PATENT DOCUMENTS

| | | | | |
|---|---|---|---|---|
| 2006/0124310 | A1 | 1/2006 | Lopez de Cardenas et al. | |
| 2008/0217021 | A1* | 9/2008 | Lembcke | E21B 33/14 166/334.4 |
| 2009/0056934 | A1 | 3/2009 | Xu | |
| 2009/0308588 | A1 | 12/2009 | Howell et al. | |
| 2011/0192613 | A1* | 8/2011 | Garcia | E21B 23/08 166/373 |
| 2013/0025868 | A1 | 1/2013 | Smith et al. | |
| 2013/0186644 | A1 | 7/2013 | Smith et al. | |
| 2013/0220603 | A1 | 8/2013 | Robison et al. | |
| 2015/0285026 | A1* | 10/2015 | Frazier | E21B 33/1291 166/120 |

FOREIGN PATENT DOCUMENTS

| | | | |
|---|---|---|---|
| RU | 2047734 | C1 | 10/1995 |
| RU | 47958 | | 9/2005 |
| RU | 2316643 | | 10/2010 |
| RU | 2495994 | C1 | 6/2012 |
| SU | 1694861 | A1 | 11/1991 |
| WO | WO2012001118 | A1 | 5/2012 |
| WO | WO2014053358 | A2 | 4/2014 |

OTHER PUBLICATIONS

Notice of Acceptance in counterpart Australian Appl. 2014271275, dated Oct. 14, 2016, 2-pgs.

Examination Report No. 2 in counterpart Australian Appl. 2014271275, dated Jul. 22, 2016, 5-pgs.

Second Office Action in counterpart Canadian Appl. 2873153, dated Dec. 19, 2016, 4-pgs.

Weatherford, "ZoneSelect MultiShift Frac Sliding Sleeve," Brochure, copyright 2009-2011.

Weatherford, "ZoneSelect SingleShot Frac Sliding Sleeve," Brochure, copyright 2009-2011.

Weatherford, "ZoneSelect i-ball Stimulation Sleeve," Brochure, copyright 2013.

Weatherford, "ZoneSelect SingleShot Frac Sliding Sleeve," Brochure, copyright 2009-2010.

Australian Patent Examination Report No. 1 filed in co-pending Australian Patent Application No. 2014271275 dated Oct. 13, 2015, 9 pages.

Canadian Examination Search Report filed in co-pending US Application No. 2,875,153 dated Feb. 29, 2016, 4 pages.

European Search Report filed in co-pending European Patent Application No. 14196403.1 dated Mar. 22, 2016, 6 pages.

Russian Office Action filed in co-pending Russian Patent Application No. 2014148748 dated Feb. 13, 2016, 14 pages.

* cited by examiner

Burst Calculations

Test 1

| | Min | Nom | Max |
|---|---|---|---|
| OD (in.) | 5.627 | 5.630 | 5.632 |
| ID (in.) | 5.251 | 5.254 | 5.256 |
| Ult. St. (psi) | 26220 | 27600 | 28980 |
| Th. (in.) | 0.188 | 0.188 | 0.188 |
| OD/Th. Ratio | 29.93 | 29.94 | 29.96 |
| Cor. Fact. | 2.13 | 2.13 | 2.13 |
| Thin (psi) | 3732 | 3920 | 4121 |
| Thick (psi) | 3856 | 4051 | 4258 |

Test 2

| | Min | Nom | Max |
|---|---|---|---|
| OD (in.) | 5.595 | 5.598 | 5.600 |
| ID (in.) | 5.252 | 5.254 | 5.257 |
| Ult. St. (psi) | 26220 | 27600 | 28980 |
| Th. (in.) | 0.172 | 0.172 | 0.172 |
| OD/Th. Ratio | 32.56 | 32.57 | 32.59 |
| Cor. Fact. | 1.54 | 1.54 | 1.54 |
| Thin (psi) | 2479 | 2608 | 2737 |
| Thick (psi) | 2555 | 2688 | 2821 |

Test 3

| | Min | Nom | Max |
|---|---|---|---|
| OD (in.) | 5.528 | 5.531 | 5.533 |
| ID (in.) | 5.252 | 5.254 | 5.257 |
| Ult. St. (psi) | 26220 | 27600 | 28980 |
| Th. (in.) | 0.138 | 0.138 | 0.138 |
| OD/Th. Ratio | 39.99 | 40.00 | 40.02 |
| Cor. Fact. | 1.16 | 1.16 | 1.16 |
| Thin (psi) | 1523 | 1602 | 1681 |
| Thick (psi) | 1561 | 1642 | 1723 |

Test 4

| | Min | Nom | Max |
|---|---|---|---|
| OD (in.) | 5.556 | 5.559 | 5.561 |
| ID (in.) | 5.252 | 5.254 | 5.257 |
| Ult. St. (psi) | 26220 | 27600 | 28980 |
| Th. (in.) | 0.152 | 0.152 | 0.152 |
| OD/Th. Ratio | 36.49 | 36.51 | 36.53 |
| Cor. Fact. | 1.31 | 1.31 | 1.31 |
| Thin (psi) | 1879 | 1977 | 2075 |
| Thick (psi) | 1930 | 2031 | 2132 |

*FIG. 9A*

BURST SLEEVE AND POSITIVE INDICATION FOR FRACTURE SLEEVE OPENING

CROSS-REFERENCE TO RELATED APPLICATIONS

This application claims the benefit of U.S. Provisional Appl. 61/911,614, filed 4 Dec. 2013, which is incorporated herein by reference.

BACKGROUND OF THE DISCLOSURE

In a staged fracturing operation, multiple zones of a formation need to be isolated sequentially for treatment. To achieve this, operators install a fracturing assembly down the wellbore, which typically has a top liner packer, open hole packers isolating the wellbore into zones, various sliding sleeves, and a wellbore isolation valve. When the zones do not need to be closed after opening, operators may use single shot sliding sleeves for the fracturing treatment. These types of sleeves are usually ball-actuated and lock open once actuated. Another type of sleeve is also ball-actuated, but can be shifted closed after opening.

Initially, operators run the fracturing assembly in the wellbore with all of the sliding sleeves closed and with the wellbore isolation valve open. Operators then deploy a setting ball to close the wellbore isolation valve. This seals off the tubing string of the assembly so the packers can be hydraulically set. At this point, operators rig up fracturing surface equipment and pump fluid down the wellbore to open a pressure actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

FIG. 1A shows an example of a sliding sleeve 10 for a multi-zone fracturing system in partial cross-section in an opened state. This sliding sleeve 10 is similar to Weatherford's ZoneSelect MultiShift fracturing sliding sleeve and can be placed between isolation packers in a multi-zone completion. The sliding sleeve 10 includes a housing 20 defining a bore 25 and having upper and lower subs 22 and 24. An inner sleeve or insert 30 can be moved within the housing's bore 25 to open or close fluid flow through the housing's flow ports 26 based on the inner sleeve 30's position.

When initially run downhole, the inner sleeve 30 positions in the housing 20 in a closed state. A breakable retainer 38 initially holds the inner sleeve 30 toward the upper sub 22, and a locking ring or dog 36 on the sleeve 30 fits into an annular slot within the housing 20. Outer seals on the inner sleeve 30 engage the housing 20's inner wall above and below the flow ports 26 to seal them off.

The inner sleeve 30 defines a bore 35 having a seat 40 fixed therein. When an appropriately sized ball lands on the seat 40, the sliding sleeve 10 can be opened when tubing pressure is applied against the seated ball 40 to move the inner sleeve 30 open. To open the sliding sleeve 10 in a fracturing operation once the appropriate amount of proppant has been pumped into a lower formation's zone, for example, operators drop an appropriately sized ball B downhole and pump the ball B until it reaches the landing seat 40 disposed in the inner sleeve 30.

Once the ball B is seated, built up pressure forces against the inner sleeve 30 in the housing 20, shearing the breakable retainer 38 and freeing the lock ring or dog 36 from the housing's annular slot so the inner sleeve 30 can slide downward. As it slides, the inner sleeve 30 uncovers the flow ports 26 so flow can be diverted to the surrounding formation. The shear values required to open the sliding sleeves 10 can range generally from 1,000 to 4,000 psi (6.9 to 27.6 MPa).

Once the sleeve 10 is open, operators can then pump proppant at high pressure down the tubing string to the open sleeve 10. The proppant and high pressure fluid flows out of the open flow ports 26 as the seated ball B prevents fluid and proppant from communicating further down the tubing string. The pressures used in the fracturing operation can reach as high as 15,000-psi.

After the fracturing job, the well is typically flowed clean, and the ball B is floated to the surface. Then, the ball seat 40 (and the ball B if remaining) is milled out. The ball seat 40 can be constructed from cast iron to facilitate milling, and the ball B can be composed of aluminum or a non-metallic material, such as a composite. Once milling is complete, the inner sleeve 30 can be closed or opened with a standard "B" shifting tool on the tool profiles 32 and 34 in the inner sleeve 30 so the sliding sleeve 10 can then function like any conventional sliding sleeve shifting with a "B" tool. The ability to selectively open and close the sliding sleeve 10 enables operators to isolate the particular section of the assembly.

Because the zones of a formation are treated in stages with the sliding sleeves 10, the lowermost sliding sleeve 10 has a ball seat 40 for the smallest ball size, and successively higher sleeves 10 have larger seats 40 for larger balls B. In this way, a specific sized ball B dropped in the tubing string will pass though the seats 40 of upper sleeves 10 and only locate and seal at a desired seat 40 in the tubing string. Despite the effectiveness of such an assembly, practical limitations restrict the number of balls B that can be effectively run in a single tubing string.

FIGS. 2A-2B illustrates another ball-actuated sliding sleeve 10 according to the prior art. To protect the sleeve 10 during run-in, cementing in the borehole, and the like, a protective cover 27 can be disposed about the exterior of the sleeve's housing to cover the flow ports 26. The protective cover 27 is typically composed of a composite material and prevents debris, cement, and the like from entering the sliding sleeve's flow ports 26 before the sliding sleeve 10 is opened. The exterior of the sleeve's housing 20 may have a slot 29 to accommodate the cover 27 flush with the exterior of the housing 20. When the sliding sleeve 10 is opened, fluid pressure from the flow ports 26 readily breaks the composite protective cover 27.

FIG. 3 illustrates another ball-actuated sliding sleeve 10 according to the prior art in partial cross-section. This ball-actuated sliding sleeve 10 counts balls of the same size before opening an inner sleeve 60. To do this, the sliding sleeve 10 includes a counter 50 and a separate seat 70. In a similar fashion to the sliding sleeve discussed above, the sliding sleeve 10 also includes a protective cover 80 to protect the sliding sleeve's flow ports 26 during run in and other operations until open. The cover 80 may also initially hold grease or other filler material in the sleeve 10 during deployment.

The protective cover 80, which is shown in more detail in FIGS. 4A-4C, is a thin sleeve and can be composed of an aluminum alloy. The protective cover 80 typically has a thickness $t_1$ of about 0.09-in. and has a diameter $d_1$ suited to fit around the outside of the housing 20, which may have a diameter of about 5.65-in. The cover 80 includes various holes or passages 84 defined from the inside 82 to the outside 86 that allow initial fluid flow from the open flow ports 26 to pass through the cover 80. Eventually, the flow, which may include proppant, erodes the cover 80 from around the housing 20 and flow ports 26, allowing the sliding sleeve 10 to be used for fracturing and other treatment operations.

During operations deploying balls to actuate the sliding sleeves downhole to treat various zones, operators want to detect an identifiable pressure spike at surface that helps indicate that a sliding sleeve has opened downhole. Currently, the sliding sleeves attempt to create a suitable surface indication using shear screws, shear rings, and the like in the sliding sleeves. When the deployed ball lands on the seat in the sliding sleeve, fluid pressure applied against the seated ball breaks the shear screws to shift the insert open in the sliding sleeve. The pressure spike and fall off measured at the surface resulting from the build up and release of pressure that break the shear screws can be used by operators to determine that the sliding sleeve has opened. In some cases, the pressure spike is insufficient to indicate opening of the sliding sleeve.

The subject matter of the present disclosure is directed to overcoming, or at least reducing the effects of, one or more of the problems set forth above.

SUMMARY OF THE DISCLOSURE

As disclosed herein, a sliding sleeve opens with a deployed plug. The sliding sleeve comprises a housing defining a first bore and defining a flow port communicating the first bore outside the housing. An inner sleeve defines a second bore and is movable axially inside the first bore from a closed position to an opened position relative to the flow port. A seat disposed in the sliding sleeve engages the deployed plug. Fluid pressure applied against the seated plug shears the insert free from the housing. For example, shear pins or other temporary attachment may hold the insert in the closed position, and the build-up of fluid pressure against the seated plug can break this attachment and allow the insert to move toward the opening position. This first pressure build-up and release may give a first indication that the sleeve has opened.

A burst band is disposed about the exterior of the housing at the flow ports. Once the insert moves to the opened position, fluid pressure applied against the seated plug passes through the open flow ports and acts against the burst band. Eventually, the burst band, which can have a number of scores, indentations, or the like, breaks and permits flow of fluid from the flow ports to pass out of the housing. Bursting of the band and the associated build-up of pressure causing it provides a second pressure indication to operators at the surface that the sliding sleeve has opened.

BRIEF DESCRIPTION OF THE DRAWINGS

FIG. 9A illustrates burst calculations for a four tests on different configurations of burst bands according to the present disclosure.

DETAILED DESCRIPTION OF THE DISCLOSURE

Figure 1A:
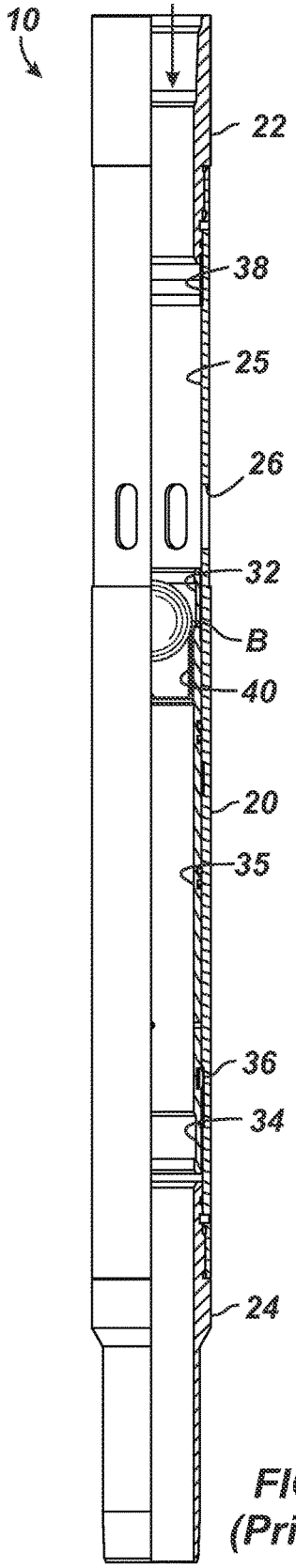
FIG. 1A (Prior Art)
FIG. 1A illustrates a ball-actuated sliding sleeve according to the prior art in partial cross-section.
Figure 1B:
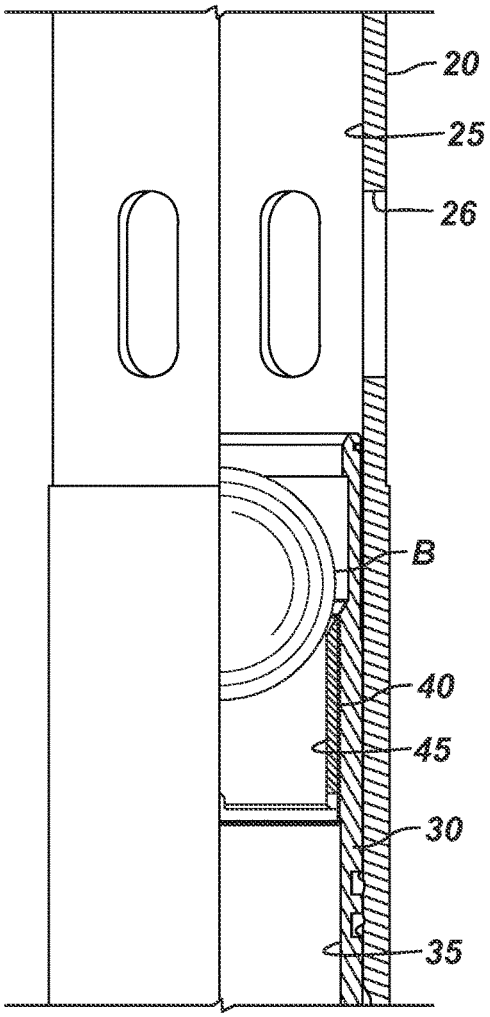
FIG. 1B (Prior Art)
FIG. 1B illustrates a detailed view of the ball-actuated sliding sleeve of FIG. 1A.
Figure 2A:
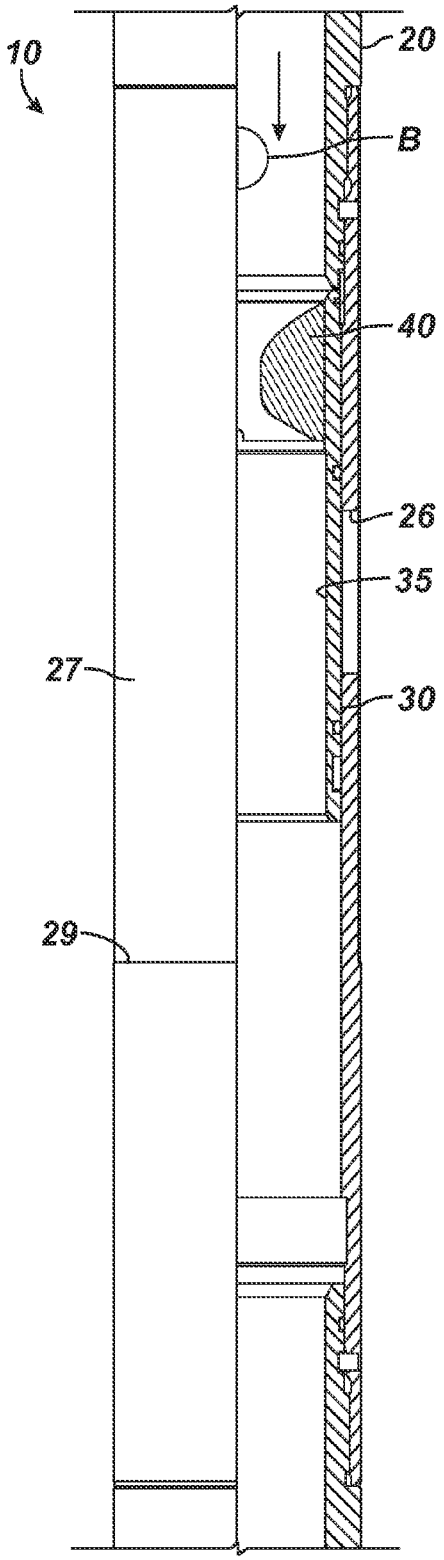
FIG. 2A (Prior Art)
FIGS. 2A-2B illustrates another ball-actuated sliding sleeve according to the prior art.
Figure 2B:
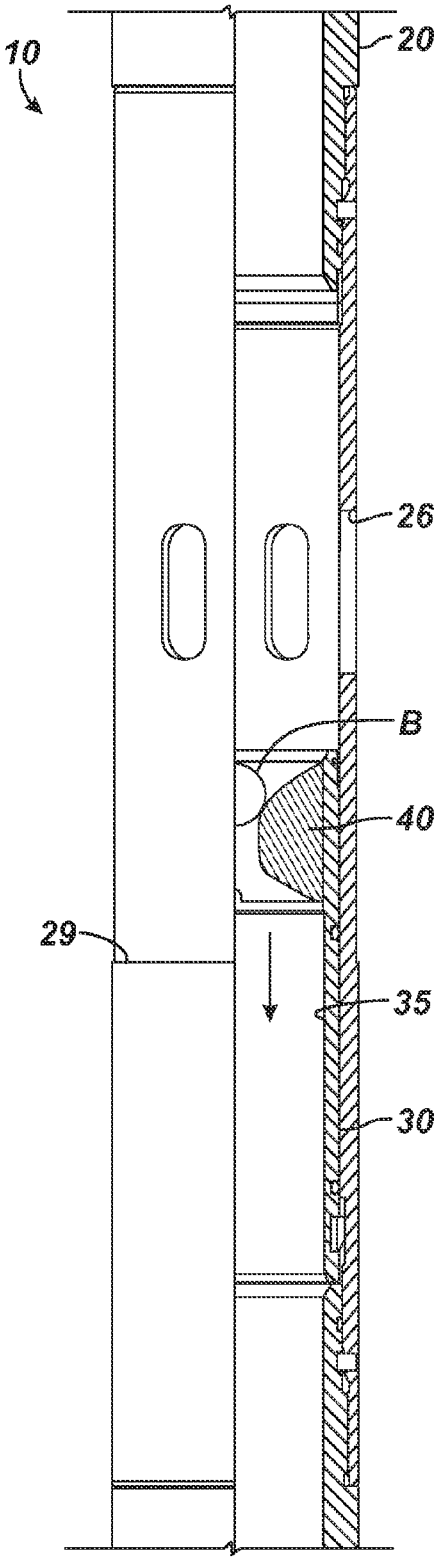
FIG. 2B (Prior Art)
Figure 3:
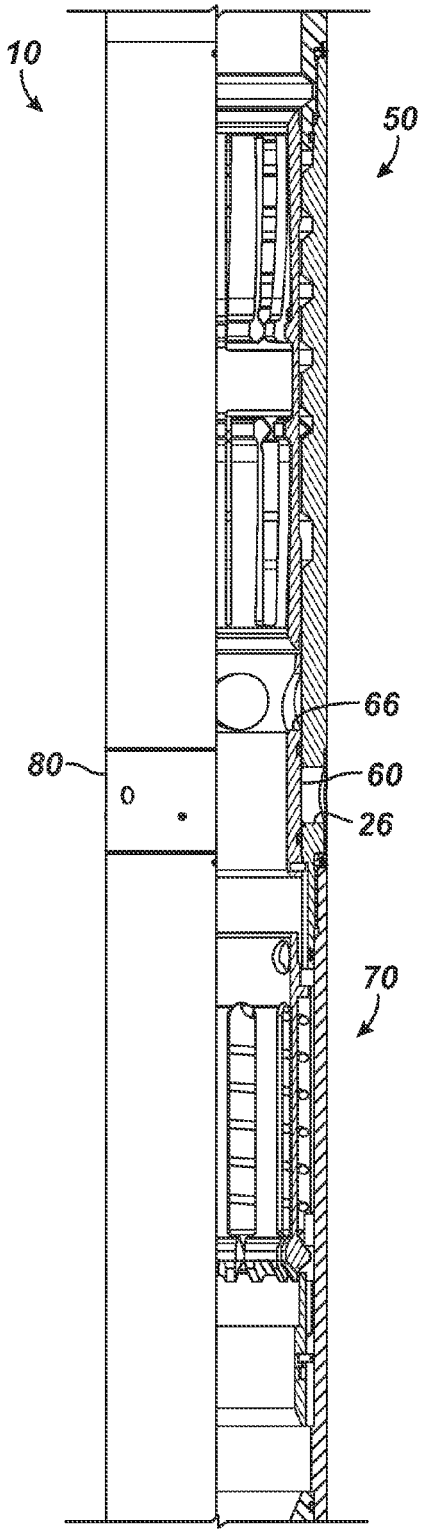
FIG. 3 (Prior Art)
FIG. 3 illustrates yet another ball-actuated sliding sleeve according to the prior art having a protective cover.
Figure 4A:
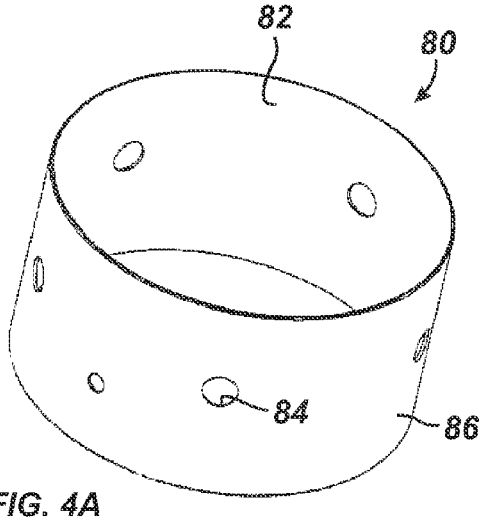
FIG. 4A (Prior Art)
FIGS. 4A-4C illustrate perspective, end-sectional, and cross-sectional views of a protective cover according to the prior art.
Figure 4B:
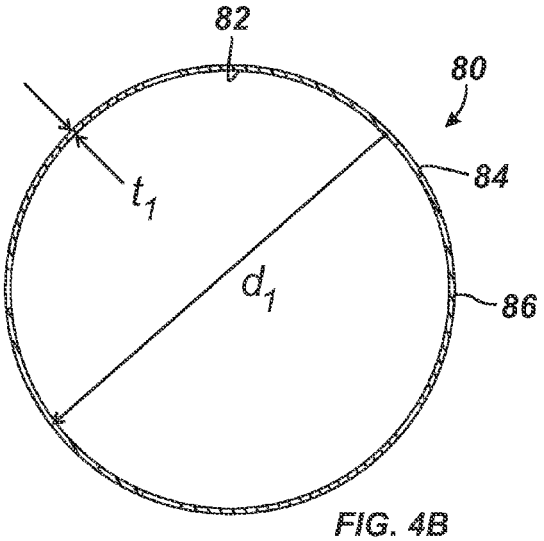
FIG. 4B (Prior Art)
Figure 4C:
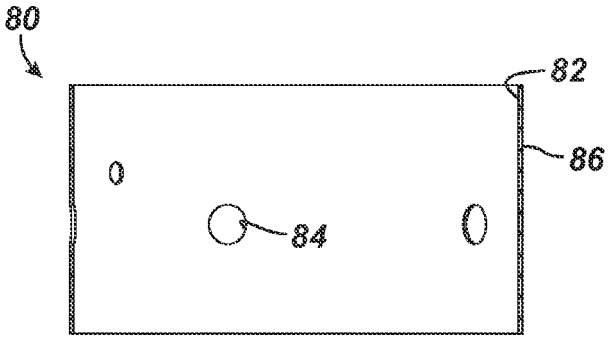
FIG. 4C (Prior Art)
Figure 5A:
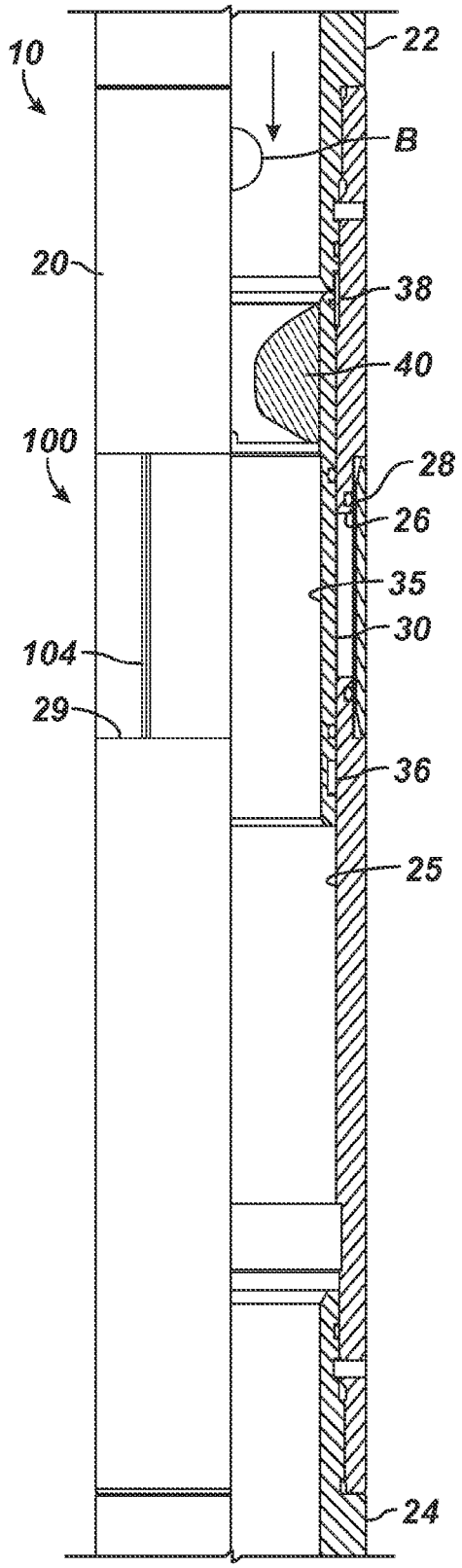
FIGS. 5A-5B illustrates a ball-actuated sliding sleeve in partial cross-section having a burst band according to the present disclosure.
Figure 5B:
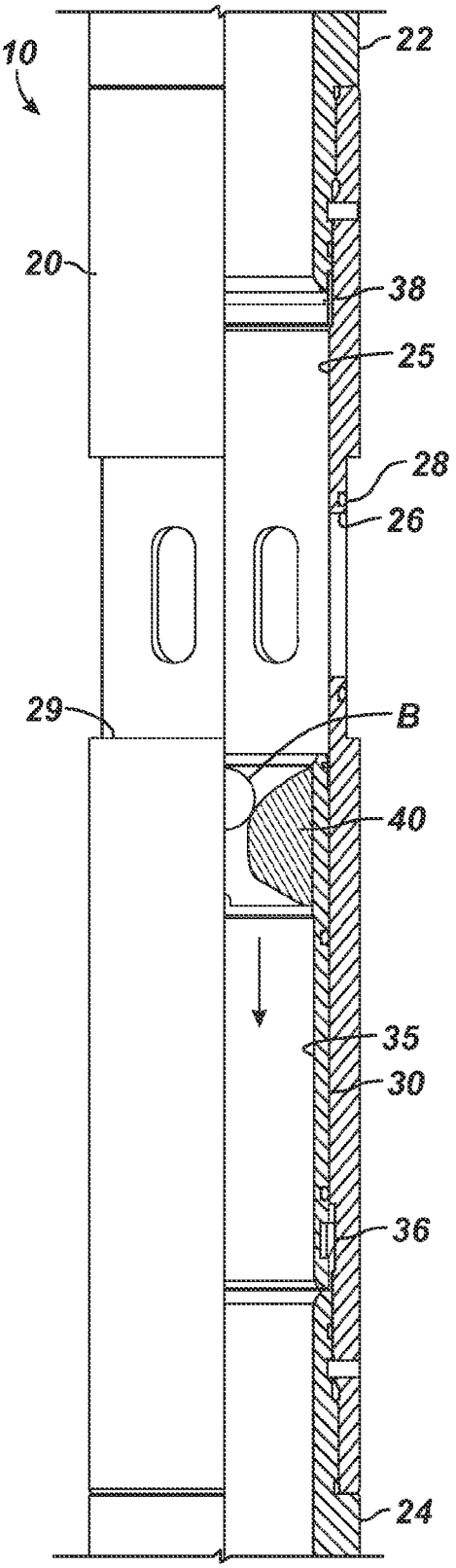

FIGS. 5A-5B illustrates a downhole tool 10 in partial cross-section having a burst band 100 according to the present disclosure. As shown, the downhole tool 10 can be a ball-actuated sliding sleeve 10, which deploys on a tubing string in a borehole and can be used for fracture operations. The sliding sleeve 10 includes a housing 20 defining a bore 25 and having upper and lower subs 22 and 24. An inner sleeve or insert 30 can be moved within the housing's bore 25 to open or close fluid flow through the housing's flow ports 26 based on the inner sleeve 30's position.

When initially run downhole, the insert 30 positions in the housing 20 in a closed state covering the flow ports 26. A breakable retainer 38 initially holds the insert 30 toward the upper sub 22, and a locking ring or dog 36 on the insert 30 fits into an annular slot within the housing 20. Outer seals on the insert 30 engage the housing 20's inner wall above and below the flow ports 26 to seal them off. Shear pins and other known features can be used to hold the insert 30 in its closed state.

The insert 30 defines a bore 35 having a seat 40 fixed therein. When an appropriately sized plug (e.g., ball, dart, etc.) lands on the seat 40, the sliding sleeve 10 can be opened when tubing pressure is applied against the seated ball 40 to move the insert 30 open. To open the sliding sleeve 10 in a fracturing operation once the appropriate amount of proppant has been pumped into a lower formation's zone, for example, operators drop an appropriately sized ball B downhole and pump the ball B until it reaches the landing seat 40 disposed in the insert 30.

Once the ball B is seated, built-up pressure forces push against the insert 30 in the housing 20, eventually shearing the breakable retainer 38 and freeing the lock ring or dog 36 from the housing's annular slot. The insert 30 can then slide downward. As it slides, the insert 30 uncovers the flow ports 26.

During opening of the sliding sleeve 10, a first surface indication can be produced when the ball B lands on the seat 40 and built-up pressure exceeds the shear value and shifts the insert 30 open. The value of this first surface indication can depend on the type of sliding sleeve 10 used, the operating pressure, shear values, and the like. The shear values required to open the insert 30 can range generally from 1,000 to 4,000 psi (6.9 to 27.6 MPa).

When the insert 30 moves open, applied fluid pressure diverted by the seated ball B acts against the burst band 100. As initially discussed, the burst band 100 is disposed around the exterior of the sleeve's housing 20 and covers the flow ports 26. Thus, the burst band 100 can provide the conventional benefits of keeping out debris from the sleeve 10 and holding in any grease or the like.

In addition to these conventional benefits, however, the burst band 100 produces a second surface indication as built-up pressure bursts the burst band 100. This second surface indication is expected to produce a signature pressure spike that can be preconfigured to a desired value for an implementation. Once the burst band 100 bursts, the sliding sleeve 10 is open to the borehole, and operators at the surface detecting the signature pressure spike can determine that the sleeve 10 has opened downhole successfully.

When it bursts, the band 100 preferably breaks into two or more pieces that fall away from the sleeve 10. It may be acceptable in some implementations to have the band 100 split at one location rather than breaking into pieces. In any event, if any piece remains adjacent the ports 26, the material can be eroded away during subsequent treatment operations.

Once the sleeve 10 is open, operators can then pump proppant at high pressure down the tubing string to the open sleeve 10. The proppant and high pressure fluid flows out of the open flow ports 26 as the seated ball B prevents fluid and proppant from communicating further down the tubing string. The pressures used in the fracturing operation can reach as high as 15,000-psi.

Preferably as shown, the burst band 100 is not connected to the internal workings of the sliding sleeve 10. Therefore, the burst band 100 is preferably disposed on the exterior of the housing 20, which may have an external slot 29 to accommodate the band 100. Fluid seals 28, such as O-rings or the like, can be disposed on the exterior of the housing 20 (and/or on the interior of the burst band 100 depending on the band's thickness). These seals 28 can contain the fluid pressure at least partially inside the sliding sleeve 10 once the insert 30 is opened. In other implementations, seals may not be used, or seals may be disposed on the band 100.

Figure 5C:
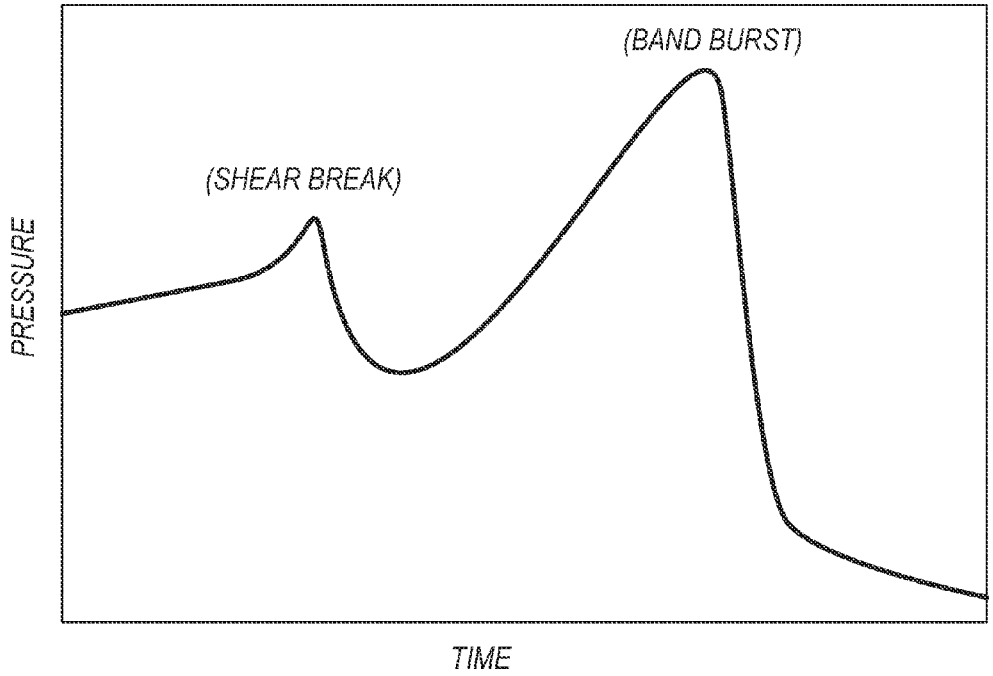
FIG. 5C graphs an example of surface indications resulting from the opening of the ball-actuated sliding sleeve having the burst band.

The burst value or surface indication value indicative of the bursting of the burst band 100 can be much higher than traditional surface indication devices. Additionally, as shown in the graph of FIG. 5C, two pressure spikes or surface indications may be produced during the opening of the sliding sleeve 10 downhole. In particular, the first indication results from the build-up and then release of fluid pressure applied against the seated ball B to shear the insert 30 open. Then, the second indication results from the build-up and then release of fluid pressure to burst the burst band 100 covering the flow ports 26. At surface using pressure measurements and known pressure devices, operators can then use the dual surface indications as further confirmation that the sliding sleeve 100 has successfully opened downhole.

Figure 6A:
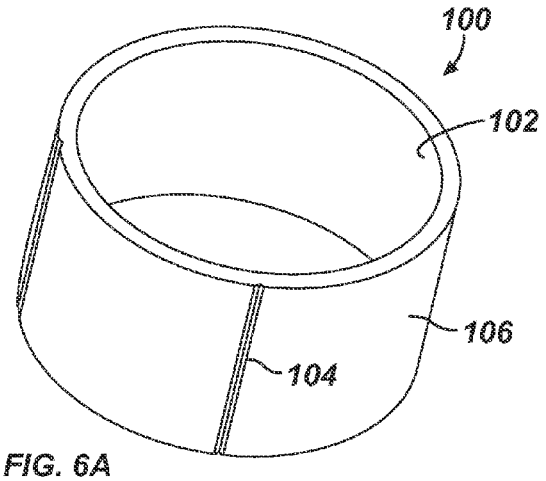
FIGS. 6A-6C illustrate perspective, end-sectional, and cross-sectional views of an burst band according to the present disclosure.
Figure 6B:
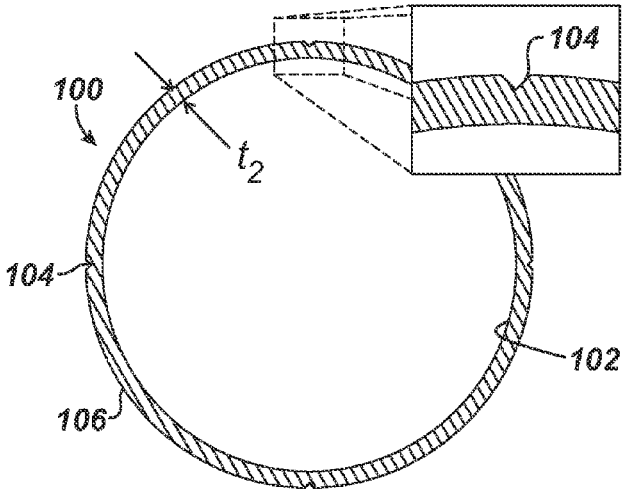
Figure 6C:
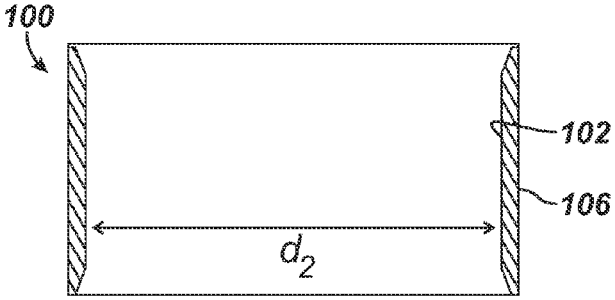

Turning now to FIGS. 6A-6C, details of one embodiment of a burst band 100 are shown in various views. The burst band 100 is preferably composed of cast iron, although other materials could be used, including other metals or non-metallic materials. The burst band 100 can have a thickness $t_2$ of about 0.4-in, but the particular thickness $t_2$ can be configured for a particular implementation and desired burst pressure as disclosed herein. The diameter $d_2$ of the band 100 depends on the diameter of the sleeve's housing 20, and in one example, the band 100 may have an inside diameter $d_2$ of about 5.25-in for a 5.5-in. sliding sleeve. The height of the band 100 for such a sliding sleeve may be about 3.2-in. Inside edges of the band 100 can be beveled at 15 to 30 degrees for about 0.1-in. Again, the particulars of the diameter, height, and the like of the burst band 100 can be configured for a particular implementation and desired burst pressure as disclosed herein.

A plurality of scores 104, indications, slots, grooves, or the like can be defined around the burst band 100 to facilitate rupture of the band 100 caused by internal pressure applied against the inner surface 102 of the band 100. The scores 104 can be machined or formed in appropriate ways and are preferably defined on the exterior surface 106 of the band 100. Additionally, the scores 104 preferably run along the longitudinal axis of the band 100 from the top to the bottom to promote splitting of the band 100.

The depth of the scores 104 can depend on the implementation and other factors (e.g., thickness of band 100, material used, burst pressure desired, etc.). In general, the scores 104 may have a depth of about 0.005 to 0.015-in., and they may define V-shaped profiles with sides angled at 45-degrees.

Any suitable number of scores 104 may be provided on the band 100, and four are shown in the present example. The number of scores 104 used about the circumference of the band 100 can be configured to facilitate bursting at a desired pressure and/or producing a desired number of burst pieces of the band 100. Preferably, at least two scores 104 are provided so that the band 100 breaks into two or more pieces. In one particular arrangement, four scores 104 are defined at every 90-degrees around the circumference of the band 100.

Overall, the pressure level required to burst the band 100 is configured by the thickness $t_2$ of the band 100, the material of the band 100, the diameter $d_2$ of the band 100, the number of flow ports 26 exposed to the band 100, the number of scores 104 defined, the depth of the scores 104, and other factors.

Figure 7:
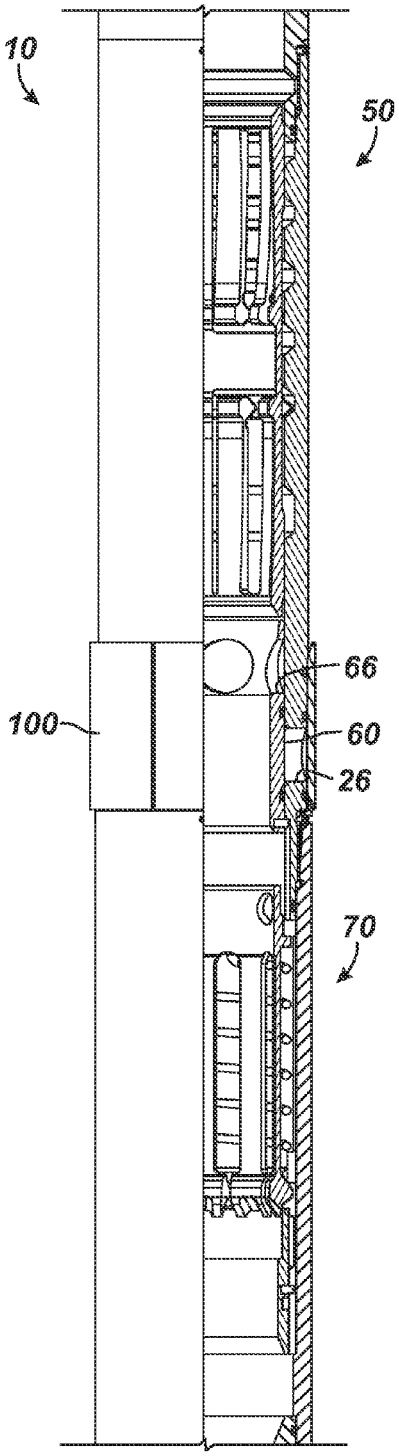
FIG. 7 illustrates another ball-actuated sliding sleeve in partial cross-section having a burst band according to the present disclosure.

FIG. 7 illustrates another downhole tool 10 in partial cross-section having a burst band 100 according to the present disclosure. This downhole tool 10 is a ball-actuated sliding sleeve that counts passage of same-sized balls before opening and is similar to the sliding sleeve disclosed in US 2013/0186644 and US 2013/0025868, which are incorporated herein by reference in their entireties. To do this counting, the sliding sleeve 10 includes a counter 50, an insert 60, and a separate seat 70. The insert 60 has flow passages 66 and seals inside the housing 26. When the insert 60 is shifted, the insert's passages 66 align with the flow ports 26 to allow fluid flow out of the sliding sleeve 10.

To help operators determine opening of the sliding sleeve's insert 60 inside the housing 20, the sliding sleeve 10 includes the burst band 100 disposed about the housing 20 around the location of the flow ports 26. Indication of the opening of this insert 60 may come primarily by the bursting of the band 100, since a shear pin or other temporary retainer may not hold the insert 60 closed. Yet, the pressure response from the counter 50 and/or seat 70 can be used as another indication. To help seal the burst band 100 in place, the housing 20 includes seals 28, such as O-rings disposed around the housing 20 both above and below the flow ports 26. Other forms of sealing can be used.

Figure 8A:
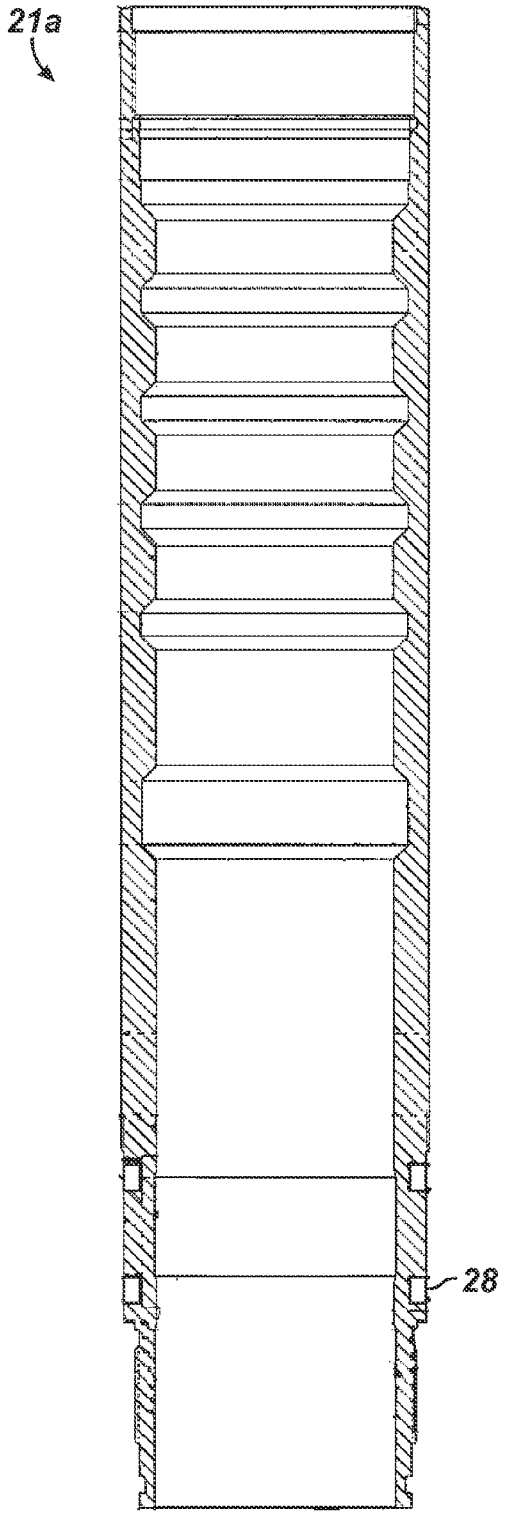
FIG. 8A illustrate a cross-sectional view of an upper housing component for the ball-actuated sliding sleeve of FIG. 6.
Figure 8B:
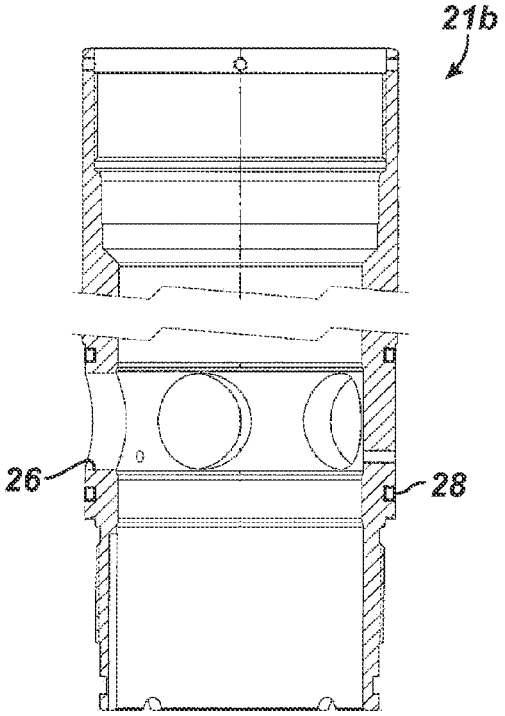
FIGS. 8B-8C illustrate cross-sectional and end-sectional views of another housing component of the ball-actuated sliding sleeve of FIG. 6.
Figure 8C:
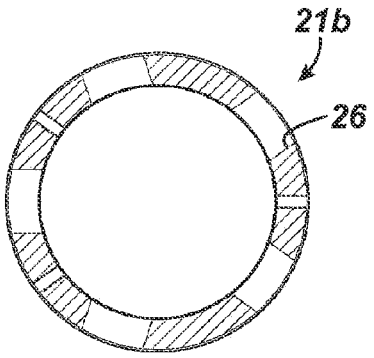

To facilitate assembly of the burst band 100 on the sliding sleeve 10, the housing 20 of the sliding sleeve 10 may include separate housing components. For example, FIG. 8A illustrates a cross-sectional view of an upper housing component 21*a* for the ball-actuated sliding sleeve 10 of FIG. 6. FIGS. 8B-8C illustrate cross-sectional and end-sectional views of another housing component 21*b* of the ball-actuated sliding sleeve 10 of FIG. 6. These two housing components 21*a-b* couple together with the burst band (not shown) disposed around their junction at the location of the flow ports 26. Both components 21*a-b* define annular slots 28 for holding O-ring seals on the exterior to engage against the inside surface of the burst band (not shown).

As noted above, the pressure at which the burst band 100 bursts depends on a number of factors and can be configured for a particular implementation. For example, FIG. 9A illustrates burst calculations for four tests on different configurations of burst bands 100 according to the present disclosure. In each of the burst test calculations, the burst bands 100 are composed of a cast iron.

The charts for each of the calculations show the outside and inside diameters (minimum, nominal, maximum) of the burst band 100, ultimate tensile strength, the band's wall thickness, the ratio of the outside diameter to the wall thickness, a correction factor, and thin and thick wall based calculations. In the first test calculation (Test 1), the band 100 has a first thickness of about 0.188-in., and it is calculated to burst at a burst pressure ranging from about 3732 to 4258-psi, depending on the various factors. In a first test run, a burst band 100 having this first thickness and having a 0.009-in groove depth for the scores was subject to burst pressure from flow ports on a sliding sleeve. The band 100 was observed to burst at 3920-psi into two overall pieces.

In the second test calculation (Test 2), the band 100 has a second thickness of about 0.172-in., and it is calculated to burst at a burst pressure ranging from about 2479 to 2821-psi, depending on the various factors. In a second test run, a burst band having this second thickness and having a 0.025-in groove depth for the scores was observed to burst at 2608-psi into three overall pieces.

In the third test calculation (Test 3), the band 100 has a third thickness of about 0.138-in., and it is calculated to burst at a burst pressure ranging from about 1523 to 1723-psi, depending on the various factors. In a third test run, a burst band having this third thickness and having a 0.059-in groove depth for the scores was observed to burst at 1602-psi into two overall pieces.

In the fourth test calculation (Test 4), the band 100 has a fourth thickness of about 0.152-in., and it is calculated to burst at a burst pressure ranging from about 1879 to 2132-psi, depending on the various factors. In a fourth test run, a burst band having this fourth thickness and having a 0.045-in groove depth for the scores was observed to burst at 1977-psi into two overall pieces.

Figure 9B:
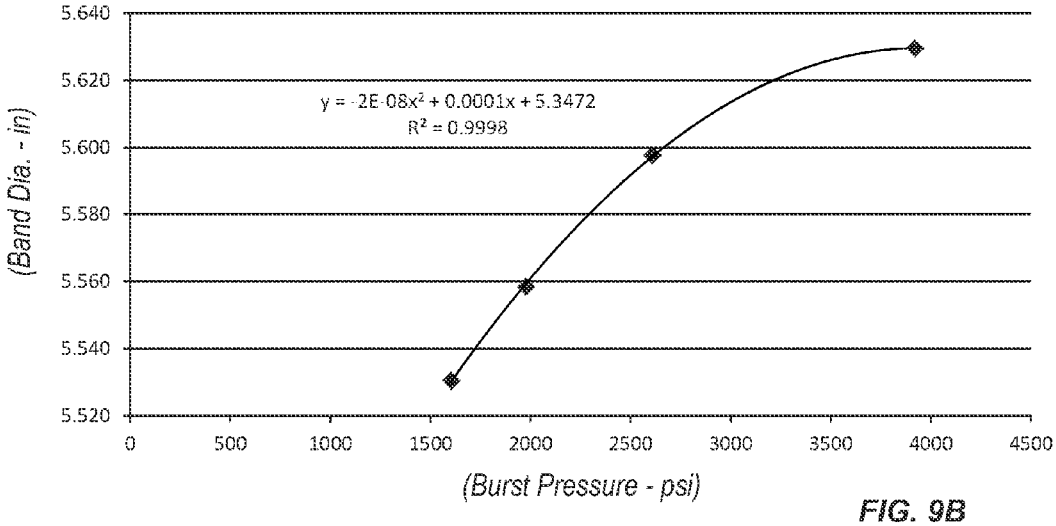
FIG. 9B graphs the correlation between the burst pressure of the burst bands to the diameter of the burst band.

Finally, FIG. 9B graphs the correlation between the calculated burst pressures of the burst bands 100 to the outside diameters of the burst bands 100 for a range between 5.52-in to 5.64-in. This correlation graphs as a polynomial equation and can be used to configure the particular factors of a burst band 100 for a particular implementation and desired burst pressure.

The foregoing description of preferred and other embodiments is not intended to limit or restrict the scope or applicability of the inventive concepts conceived of by the Applicants. For example, although the present disclosure focuses on verifying the opening of a sliding sleeve, such as a fracture sleeve, opened by a deployed plug or ball, the teachings of the present disclosure can apply to any other type of downhole tool used on a tubing string, such as a pressure-actuated sleeve, a ball-actuated sleeve, a toe sleeve, a stage tool, and the like.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool, comprising:

a housing defining an internal bore and defining at least one port communicating the internal bore outside the housing;

an insert disposed in the internal bore, the insert movable at least from a closed position to an opened position relative to the at least one port in response to a first pressure level and producing a first pressure response at surface indicative of opening of the downhole tool; and a burst band disposed outside the housing at the at least one port, the burst band breaking away from the housing in response to a second pressure level communicated to the at least one port when the insert is in the opened position and producing a second pressure response at surface indicative of opening of the downhole tool.

2. The tool of claim 1, wherein the insert comprises a seat engaging a plug deployed therein, the insert moving from the closed position to the opened position in response to fluid pressure applied against the deployed plug engaged with the seat.

3. The tool of claim 2, wherein a temporary attachment holds the insert in the closed position and releases the insert to move to the opened position in response to a first pressure level.

4. The tool of claim 3, wherein the first pressure level is less than the second pressure level.

5. The tool of claim 3, wherein the first pressure level is approximately 1,000 to 4,000 psi.

6. The tool of claim 3, wherein the second pressure level is approximately 1,500 to 4,300 psi.

7. The tool of claim 1, wherein the housing comprises seals disposed about the housing and sealing the at least one port with an inside surface of the burst band.

8. The tool of claim 1, wherein the burst band is composed of a cast iron.

9. The tool of claim 1, wherein the burst band defines at least one groove on an outside surface of the burst band.

10. The tool of claim 9, wherein the at least one groove is defined from end-to-end along an axis of the burst band.

11. The tool of claim 1, wherein the housing comprises first and second housing components coupling together end-to-end, the burst band inserting at least partially on one of the ends of one of the housing components.

12. A method of opening a downhole tool, the method comprising:

providing a downhole tool comprising a housing, an insert, and a burst band, the housing defining an internal bore and defining at least one port communicating the internal bore outside the housing, the insert disposed in the internal bore and moveable at least from a closed position to an opened position relative to the at least one port, the burst band disposed outside the housing at the at least one port;

applying a first fluid pressure at a first pressure level downhole to the downhole tool;

obtaining a first pressure response at surface indicative of opening of the downhole tool in response to the first applied fluid pressure at the first pressure level by moving the insert from the closed position to the opened position relative to the at least one port;

applying a second fluid pressure at a second pressure level downhole to the downhole tool subsequent to the first pressure response; and obtaining a second pressure response at surface indicative of the opening of the downhole tool in response to the second applied fluid pressure at the second pressure level by bursting the burst band away from the at least one port on the downhole tool in response to the second pressure level of the second applied fluid pressure.

13. The method of claim 12, wherein obtaining the first pressure response indicative of opening of the downhole tool in response to the first applied fluid pressure comprises shearing the insert to move in the downhole tool in response to the first pressure level of the first applied fluid pressure.

14. The method of claim 12, initially comprising deploying a plug downhole to a seat on the insert of the downhole tool.

15. The method of claim 14, wherein applying the first fluid pressure downhole to the downhole tool comprises applying the first fluid pressure against the deployed plug engaged against the seat on the insert in the downhole tool.

16. The method of claim 15, wherein applying the second fluid pressure downhole to the downhole tool subsequent to the first pressure response comprises diverting the second fluid pressure out of the at least one port on the downhole tool and applying the diverted fluid pressure against the burst band disposed outside the downhole tool.

17. The method of claim 16, wherein applying the diverted fluid pressure against the burst band disposed outside the downhole tool comprises applying the diverted fluid pressure against the burst band in sealed engagement with the at least one port of the downhole tool.

* * * * *